United States Patent [19]

Long

[11] 4,010,958

[45] Mar. 8, 1977

[54] GOLF PUTTER

[76] Inventor: Steven K. Long, 17151 Almaden Road, San Jose, Calif. 95120

[22] Filed: Nov. 19, 1973

[21] Appl. No.: 416,969

[52] U.S. Cl. ..... 273/169; 273/80 C; 273/164; 273/167 F; 273/167 G

[51] Int. Cl.[2] ..... A63B 53/04

[58] Field of Search ..... 273/77 R, 80 C, 164, 273/167–175, 80.2–80.8; D34/5 GC, 5 GH

[56] References Cited

UNITED STATES PATENTS

| | | | |
|---|---|---|---|
| 1,459,810 | 6/1923 | Wills | 273/169 |
| 1,511,479 | 10/1924 | Kelly et al. | 273/168 X |
| 1,666,174 | 4/1928 | Holland | 273/169 X |
| 2,056,335 | 10/1936 | Wettlaufer | 273/171 X |
| 2,067,556 | 1/1937 | Wettlaufer | 273/171 X |
| 2,708,579 | 5/1955 | Hugman | 273/168 X |
| 3,042,405 | 7/1962 | Solheim | 273/168 X |
| 3,305,235 | 2/1967 | Williams | 273/169 X |
| 3,516,674 | 6/1970 | Scarborough | 273/171 X |
| 3,652,094 | 3/1972 | Glover | 273/171 |
| 3,770,279 | 11/1973 | Phinny | 273/167 F X |
| 3,966,210 | 6/1976 | Rozmus | 273/167 G |
| D193,897 | 10/1962 | Vachon | 273/167 D UX |
| D204,002 | 3/1966 | Tanis | 273/80 C X |
| D206,540 | 12/1966 | MacKenzie | 273/167 D UX |
| D231,373 | 4/1974 | Pavelle | 273/167 D X |

FOREIGN PATENTS OR APPLICATIONS

| | | | |
|---|---|---|---|
| 12,743 | 7/1901 | United Kingdom | 273/80 C |
| 304,008 | 1/1929 | United Kingdom | 273/169 |

*Primary Examiner*—Richard J. Apley

[57] ABSTRACT

A golf putter in which mass is disposed at the corners of the club head to increase the effective hitting area of the face of the club head. The effective hitting area is not only increased in the longitudinal or horizontal direction of the face of the club head, but also in the vertical or transverse direction of the face of the club head. In addition, the density at the corners of the club head is greater than the density about the center of the mass to increase the inertia of rotation of the club head.

16 Claims, 6 Drawing Figures

Fig. 1
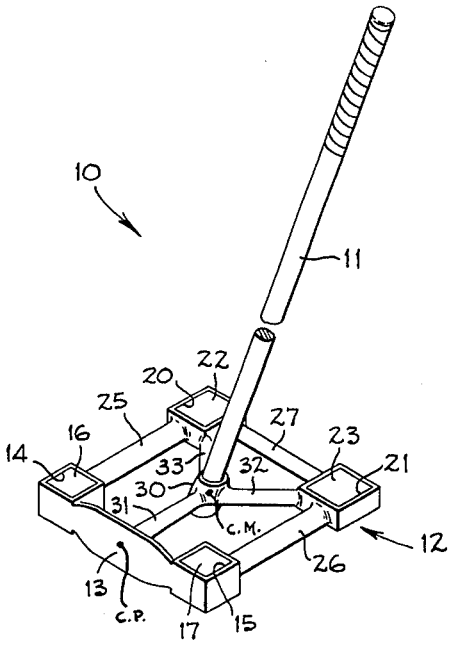
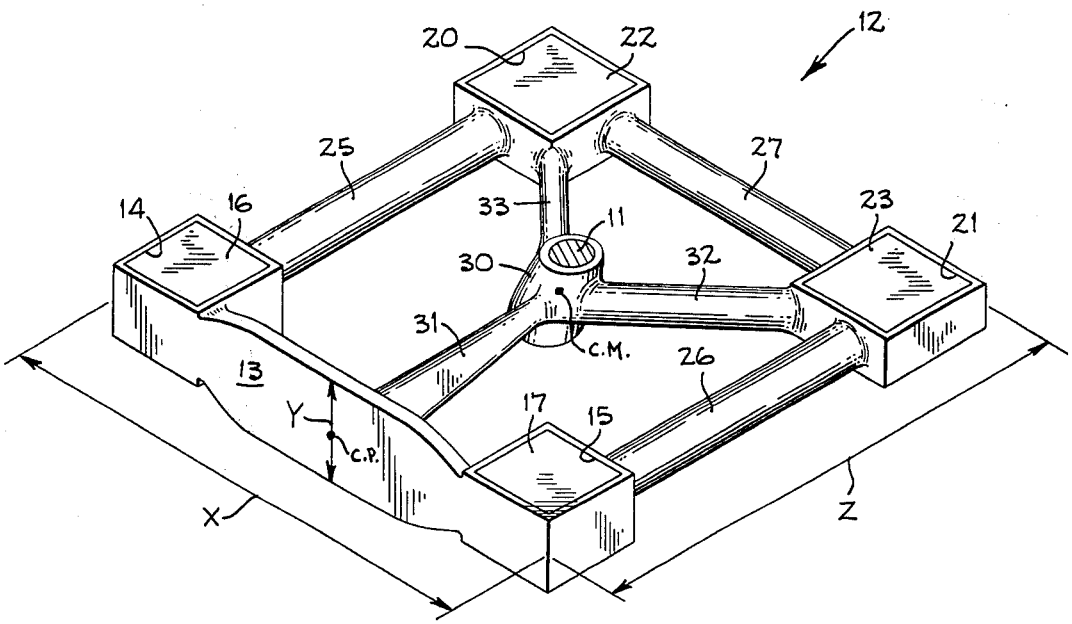
Fig. 2

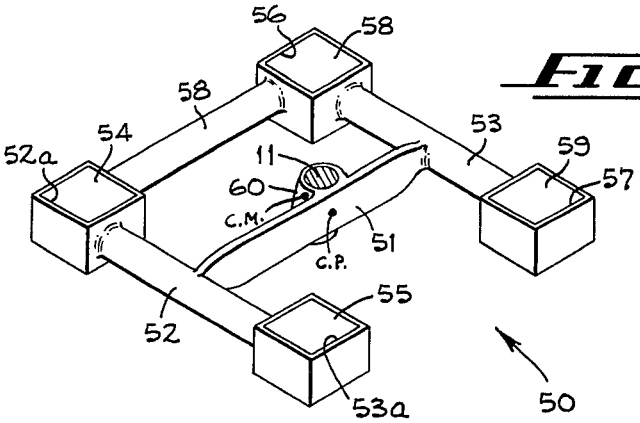
Fig_3
Fig_6
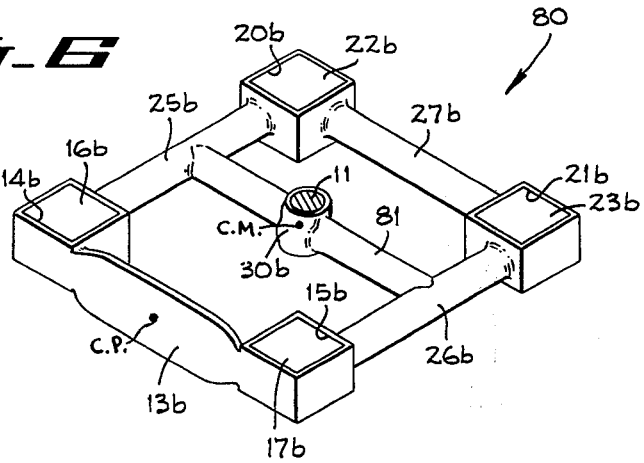
Fig_5
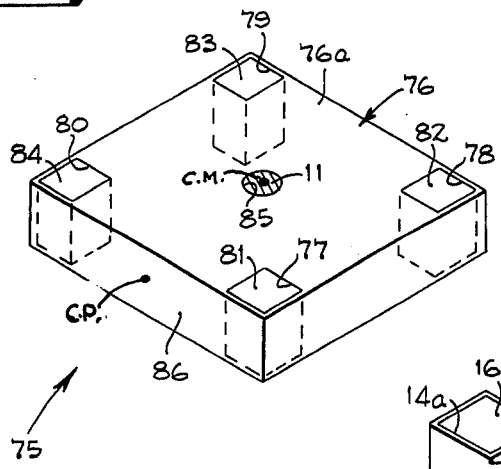
Fig_4
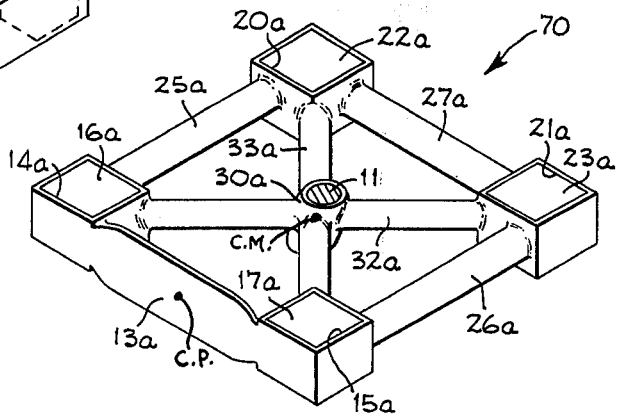

GOLF PUTTER

BACKGROUND OF THE INVENTION

The present invention relates in general to golf clubs, and more particularly to golf putters.

Some golf clubs are designed to reduce the effect of imperfect strokes. It is desirable to hit the golf ball at the center of percussion of the face or hitting surface of the club head. The greater the distance between the point of contact of the ball and the center of percussion of the face of the club head, the greater the loss of velocity of the stroked ball and the lesser control over the direction of travel of the stroked ball. Thus, as the ball is hit closer to the center of percussion of the face of the club head, the greater is the efficiency of the transfer of energy from the golf club to the golf ball. This results in greater distance of travel and less deviation in the direction of travel of the stroked ball.

Since it is difficult for a golfer to hit the center of percussion, it is desirable to use a golf club that reduces the ill effects of hitting away from that center. This has been accomplished by increasing the horizontally operating rotational inertia in a limited fashion. Heretofore, the distribution of mass of the club head has been selected to increase the density or weight of the club head at the heel and toe ends while reducing by an equal amount the weight or density in mid section so as to increase the effective hitting area.

In the patent to Scarborough U.S. Pat. No. 3,516,674, there is disclosed a golf putter in which weights are disposed at the aft ends of the club head to reduce the twisting of the putter caused by contact with the ball offset from the center of percussion of the face of the club head. Other U.S. patents of interest are U.S. Pat. No. 1,517,476 and U.S. Pat. No. 1,459,810, in which weights have been employed in golf clubs. Putters have been produced in which a recessed area slightly smaller than a golf ball has been formed centrally of the club head. Putters have been produced in which weights have been disposed at the center of the club head and other putters have been produced in which weights are spaced apart in the tow-heel direction. In other instances, putters have been produced in which a single piece U-shaped weight has been disposed at the center of the club head. Putters with a shaft connected at the center of the club head have been disclosed in the U.S. Pat. Nos. 1,517,476 and 1,459,810.

SUMMARY OF THE INVENTION

A golf putter in which weights or greater mass is disposed at the corners of the club head to increase the effective hitting area on the face of the club head.

A golf putter in which mass is removed to both the toe and heel of the club head and to the fore (club face) and aft ends of the club head, in the line of flight direction and particularly at the extremities thereof to increase the effective hitting area of the club head by increasing the inertia of rotation of the club head.

A golf putter in which a heavier density is present at the corners of the club head with respect to the density of the remainder of the club head to increase the effective hitting area of the club head.

By virtue of the present invention, the area of the face of the club head which produces the maximum efficiency for the transfer of energy from the golf club to the golf ball is increased not only in the longitudinal direction of the face of the club head but also in the transverse or vertical direction of the face of the club head.

By increasing the effective hitting area of the club head, the opportunity for an imperfect stroke is reduced. It is known that when the point of impact between the face of the club head and the golf ball is removed from the center of percussion, there is a loss of transfer of energy from the golf club to the golf ball. The greater the distance therebetween, the greater the loss of transfer of energy. As a consequence of the loss of transfer of energy, the lesser the velocity for the stroked ball. In addition thereto, there is a loss of control over the direction of travel of the stroked ball. When the stroke is imperfect in the above-mentioned sense, the club twists upon contact with the golf ball, sending the ball astray.

In the present invention, the outward distribution of the mass of the club head is increased in the heel-toe directions in the line of flight directions of the club head. To increase the rotational inertia of the golf club, it is desirable to have a greater mass of the club head at the portions of the club head removed as much as possible from the dimensional center and the center of mass of the club head given the limitation on club head size imposed by the golfer's needs in the relation of putter to ground. The ground tends to get in the way of club head movement. A club large in heel-toe dimension will more easily catch the ground at the heel or toe end due to unlevel ground, long grass, or faulty positioning by the golfer. A club large in the line of flight dimension will more easily catch the ground at the front and back of the club head since the arc of movement is greater and closer to the ground at certain times for points to the extreme front and back of club head. consequently, enlargement of the club head is limited in heel-toe and line of flight dimensions. Hence, the furthest points from the center of the club head, given heel-toe and line of flight dimensions of the club head, are located at corners made by perpendicular intersecting straight lines that delineate the maximum dimensions at the heel, toe, front, and back. That is, without exceeding the maximum dimensions, mass can be removed to positions at four corners which are actually further from the center of mass of the club head than mass located in any other positions. Aside from practical limitations on size, the United States Golf Association (U.S.G.A.) prevents the use of club heads which are larger from front to back than from heel to toe. This limits the maximum size of a club head to the shape of a square. Stated otherwise, mass removed to may be added at the extremities or the corners of the club head to increase the rotational inertia of the club head. To maintain the maximum rotational inertia, the center of the rotation should be at the center of the club head with respect to its dimensions. When the mass at the extremities of the club head is increased, it may be desirable to reduce the mass of the club head at the remaining portions thereof to maintain a desired overall weight for the club head.

It is a feature of the present invention to provide a golf putter in which the density and mass of the club head is greater at the extremities or corners of the club head than about the center of the club head. In so doing, the inertia of rotation of the club head is increased.

Another feature of the present invention, though not novel, is the attachment of the club shaft axis at or adjacent to the center of mass of the club head. The locating of the shaft axis at or adjacent to the center of mass of the club head. The locating of the shaft axis at or adjacent to the center of mass of the club head gives improved balance for the holding of the putter and also reduces twisting of the club shaft in the hands of the operator during movement of the golf club prior to hitting the golf ball.

DESCRIPTION OF THE DRAWINGS

FIG. 1 is a perspective view of the golf club embodying the present invention.

FIG. 2 is an enlarged perspective view of the club head of the golf club shown in FIG. 1 with the shaft illustrated in section.

FIG. 3 is a perspective view of a modification of the club head shown in FIGS. 1 and 2 with the shaft illustrated in section.

FIG. 4 is a perspective view of a further modification of the club head shown in FIGS. 1 and 2 with the shaft illustrated in section.

FIG. 5 is a perspective view of a still further modification of the club head shown in FIGS. 1 and 2 with the shaft illustrated in section.

FIG. 6 is a perspective view of a still further modification of the club head shown in FIGS. 1 and 2 with the shaft illustrated in section.

DESCRIPTION OF THE PREFERRED EMBODIMENTS

Illustrated in FIG. 1 is a golf putter 10 embodying the present invention. The golf putter 10 comprises a shaft 11 and a club head 12.

The club head 12 comprises a face 13, which is the portion of the club head 12 intended to contact the golf ball. The club face 13 is elongated in the horizontal direction of the club head 12. The toe-heel direction or the horizontal direction of the club head may also be referred to as the direction of the width of the club head, which is shown as "X" arrows in FIG. 2.

At the center of the club face 13 is the center of percussion. A golf ball hit by the club face 13 at the center of percussion produces the maximum transfer of energy from the putter 10 to the golf ball, produces the maximum velocity for the golf ball stroked with other controlling conditions remaining constant, produces the minimum deviation from the intended direction of travel of the ball stroked. In the preferred embodiment, the club face 13 is made of aluminum.

Sockets 14 and 15 of the club head 12 are integrally formed or fixedly secured to the club face 13. Fixedly seated within the sockets 14 and 15 are weights 16 and 17, respectively, of a material of greater density than the club head 12. A weight of greater density occupies less space than would a weight of less dense material, thus saving space at the corner locations, which makes possible greater concentration toward the corners and less vertical depth of the weights.

The sockets 14 and 15 may be integrally formed with the club face 13 and made of aluminum. Fixedly seated within the sockets 14 and 15, respectively, by an epoxy resin or the like, may be lead weights 16 and 17. It is apparent that the lead may be poured into the sockets in a molten state and when cooled and stamped into place, the lead will be secured in the pockets. aft of the sockets 14 and 15, respectively. The sockets 14, 15, 20 and 21 are at the extremities or corners of the club head 12 and define a square and serve with apparent that to increase the sweet spot in both the X direction and the Y direction. In other words, the club head 12 has a generally square configuration with the width of the club head 12 equal to the length of the club head 12. The width is considered in the toe-heel direction and the length is considered in the fore-aft direction or the line of flight direction for the club head 12 as shown by the arrows "Z" in FIG. 2.

Fixedly seated with the sockets 20 and 21 by an epoxy resin, pressing or the like are weights 22 and 23, respectively, of the club head 12 of a material of greater density than the remaining portions of the club head 12, such as lead. Interconnecting the sockets 14 and 20 is a strut 25 of the club head 12 and interconnecting the sockets 21 and 15 is a strut 26. Interconnecting the sockets 20 and 21 is a strut 27 of the club head 12. The struts 25–27 and the sockets 20 and 21 are made of aluminum. The club face 13, the sockets 14, 15, 20 and 21, and the struts 25–27 may be integrally formed. will be of the same density or material as the weights 16 and 17. The weight of the corners at the sockets 14 and 15 will generally be less than the weight of the corners at the sockets 20 and 21 to balance the overall weight distribution of the club head 12, since the club face 13 will generally be heavier than the strut 27.

It is within the contemplation of the present invention that the weights at the corners or extremities 16, 17, 22 and 23, respectively, of the club head 12 be of a greater density than the remaining portions of the club head 12. Weights at the corners 14, 15, 22 and 23 may be of lead disposed at the extremities of the club head 12.

Centrally disposed on the club head 12 with respect to the corners 16, 17, 22 and 23 thereof is an upwardly extending member 30 of the club head 12 of aluminum. The member 30 extends downwardly a sufficient distance to contact the ground as a supporting element. Surrounding the upright member 30 and fixedly secured thereto is the lower end of the suitable putter shaft 11. Bar 31 of the club head 12 interconnects the club face 13 and the upwardly extending member 30. A bar 32 of the club head 12 interconnects the socket 21 and the upwardly extending member 30 and a bar 33 of the club head 12 interconnects the upwardly extending member 30 and the sockets 20. The bars 31–33 are made of aluminum. The club face 13, the sockets 14, 15, 20 and 21, the struts 25–27, the upwardly extending member 30 and the bars 31–33 are preferably made of aluminum and may be integrally formed by an aluminum casting.

The axis of the upstanding member 30 is either immediately adjacent to or coincident with the center of mass of the club head 12. The center of mass is preferably located at the center of the club head 12 with respect to the dimensions of the width (X arrows of FIG. 2) and length (Z arrows of FIG. 2) of the club head 12.

By placing the weights or greater density material at the corners 14, 15, 20 and 21 or extremities of the club head 12, the inertia of rotation of the club head 12 has increased. This improves the direction of travel of a ball toward the ideal direction as it existed normal of the club face at the first moment of contact. Additionally, placing the weights or greater density material at the corners or extremities 14, 15, 20 and 21 of the club head 12 serves to increase the effective fitting area in both the longitudinal direction of the club face 13 as shown by the arrows "X" in FIG. 2 and in the transverse direction of the club face 13 as shown by the arrows "Y" in FIG. 2.

In a typical embodiment, the width of the club head 12 (X arrows of FIG. 2) is five inches and the length of the club head 12 (Z arrows of FIG. 2) is five inches. The sockets 20 and 21 are respectively 1 inch by 1 inch by ½ inch. The sockets 14 and 15 are 13/16 inch × 13/16 inch × ⅝ inch. The distance from the club face to the axis of the upwardly extending member 30 is 2½ inches. The above dimensions are approximate and relate only to a typical embodiment.

In FIG. 3 is illustrated a club head 50, which is a modification of the club head 12. The club head 50 comprises a club face 51. Fixed to the ends of the club face 51 at right angles thereto are struts 52 and 53. Fixed to the ends of the strut 52 are sockets 52*a* and 53*a*. Fixedly seated in the sockets 52*a* and 53*a* are weights 54 and 55, respectively. Fixed or integrally formed with the ends of the strut 53 are sockets 56 and 57, which have weights 58 and 59 fixedly seated therein. A strut 58 is fixed to the sockets 52*a* and 56. Upstanding from the rear and center of the club face 51 is an upwardly extending member 60. The shaft 11 is fixed to the upwardly extending member 60 which surrounds the shaft 11 at the lower end thereof. In this arrangement, the golf ball is contacted by the club face 51 at the center of mass. Thus, the club rotation is reduced in the event of a cutting stroke.

The club face 51, the sockets 52*a*, 53*a*, 56 and 57, the struts 52, 53 and 58, and the upstanding member 60 may be made of aluminum and may be integrally formed by aluminum casting, or the like. The weights 52, 53, 58 and 59 may be fixed to the sockets 52, 53, 56 and 57, respectively, by an epoxy resin or may be cast and pressed thereinto. The weights 52, 53, 58 and 59 may be made of lead.

The axis of the upstanding member 60 is coincident with or immediately adjacent to the center of mass of the club head 50. The center of mass is centrally located with respect to the width and length dimensions of the club head 50. The four corners 52*a*, 53*a*, 56 and 57 define preferably a square. The length of the club head 50 is equal to the width of the club head 50. It is within the contemplation of the present invention that the club head 50 as well as the other club heads may have a rectangular configuration.

FIG. 4 illustrates a club head 70, which is a further modification of the club head 12. The club head 70 is similar to the club head 12 except for the omission of the bar 31 and the respective extensions of the bars 32 and 33 to form an X configuration with the bar 32 fixed to the sockets 14 and 21 and with the bar 33 fixed to the sockets 15 and 20. The center of the X configuration for the bars 32 and 33 in coincident with or immediately adjacent to the axis of the upstanding member 30. Therefore, like parts are shown with the same reference numerals but with the suffix *a* added to the reference numbers. The club head 70 provides greater yieldability of the club face 13*a* when it contacts the golf ball.

FIG. 5 illustrates a still further modification of the club head 12. The club head 75 of the FIG. 5 comprises a block 76, which may have a generally square or rectangular foreaft surface 76*a*. The block may be of aluminum, wood or other suitable material. The corners of the block 76 are formed with cavities 77–80, which are filled with materials of a greater density than the remaining portion of the block 76. For example, the cavities 77–80 may be filled with rectanguloids of lead 81–84. The cavities 77–80 could be cylindrical and also filled with a higher density material than the rest of the block 76 having conforming cylindrical configurations.

A bore 85 may be formed in the block 76 from the surface 76a. The shaft 11 has its lower end surrounded and fixed to the block 76 in the bore 85. A hosel extending from the block 76 may be employed equally as well. A wall 86 is the front face of the club head 75. The bore 85 is at the center of the club head 75 with respect to the width and length. The axis of the bore 85 is coincident with the center of mass of the club head 75.

FIG. 6 illustrates a club head 80, which is a further modification of the club head 12. The club head 80 is similar to the club head 12 except for the omission of the bars 31–33 and the inclusion of a bar 81, which extends normally between confronting struts. Therefore, like parts are shown with the same reference numerals but with the suffix *b* added to the reference numerals. The upstanding member 30b is fixed to or integral with the bar 81. It is apparent that in any putter head design, the shaft may surround a hose or upstanding member, or be received by a bore or receptacle, the latter of which may exist in an upstanding member or in the club head. Each method is commonly used in their industry. It is also apparent that the fore-aft dimension of the club head in this invention does not have to be as great as the heel-toe dimension while still producing a club with substantially more rotational inertia of both types than previously known club heads. It is further apparent that a greater mass may be employed at the corners as well as a material of greater density, so that mass can be increased by increasing the amount of a given material as well as by increasing the density of the material at the corners.

I claim:

1. A golf club comprising:

A. a club shaft;

B. a club head carried by the lower end of said club shaft, said club head having a substantially right-angled polygonal configuration in the plan view, said club head comprising:

a. a first weighting means located at the front heel corner of the club head, b. a second weighting means spaced from said first weighting means in the toe-heel direction of said club head and located at the front toe corner of said club head, c. a club face extending in the toe-heel direction, d. a third weighting means spaced from said first weighting means in the aft direction of said club head and located at the rear heel corner of said club head, e. a fourth weighting means spaced from said second weighting means in the aft direction of said club head and spaced from said third weighting means in the toe-heel direction of said club head and located at the rear toe corner of said club head, f. shaft support means, to connect said shaft to said club head, g. means connecting the weighting means to each other, h. said weighting means having a greater mass than said shaft support means and said connecting means.

2. A golf club according to claim 1 wherein said connecting means includes a first strut interconnecting said first and third weighting means and a second strut interconnecting said second and fourth means, and with said club face extending between said first and second weighting means.

3. A golf clup according to claim 2 wherein said first and second struts are in parallel relation and perpendicular to the toe-heel direction of said club head.

4. A golf club according to claim 2 wherein said shaft support means includes an upwardly extending member fixedly secured to the lower end of said shaft.

5. A golf club according to claim 4 wherein said shaft support means includes a third strut interconnecting said third weighting means and said upwardly extending member and a fourth strut interconnecting said fourth weighting means and said upwardly extending member.

6. A golf club according to claim 5 wherein said shaft support means includes a fifth strut interconnecting said club face and said upwardly extending member.

7. A golf club according to claim 6 wherein said said connecting means includes a sixth strut interconnecting said third and fourth weighting means.

8. A golf club according to claim 2 wherein said shaft support locating means includes an upwardly extending member fixedly secured to the lower end of said shaft, and with said shaft support means being connected to said first, second, third and fourth weighting means and said upwardly extending member for supporting said upwardly extending member from said club head.

9. A golf club according to claim 8 wherein said shaft support means includes a third strut extending diagonally between said first and fourth weighting means and a fourth strut extending diagonally between said second and third weighting means and intersecting said third strut, said upwardly extending member being fixed to said third and fourth struts at the intersection thereof.

10. A golf club according to claim 9 wherein said connecting means includes a fifth strut interconnecting said third and fourth weighting means.

11. A golf club according to claim 2 wherein said shaft support means includes a third strut extending between said first and second struts.

12. A golf club according to claim 11 wherein said connecting means includes a fourth strut interconnecting said third and fourth weighting means, 13. A golf club according to claim 12 wherein said shaft support locating means includes an upwardly extending member fixedly secured to the lower end of said shaft and to said third strut.

14. A golf club according to claim 2 wherein said connecting means includes a third strut interconnecting said third and fourth weighting means.

15. A golf club according to claim 1 wherein said connecting means includes a first strut interconnecting said first and third weighting means and a second strut interconnecting said second and fourth weighting means, and with said club face extending between said first and second struts.

16. A golf club according to claim 1 wherein said connecting means and said shaft support means is in the form of a block and wherein said club face is the ball contact surface of said block.

* * * * *